United States Patent [19]

Bernstein et al.

[11] 4,235,696

[45] Nov. 25, 1980

[54] MANDREL FOR NICKEL ROUNDS WITH A MONOLITHIC SURFACE

[75] Inventors: Philip Bernstein, Glen Ridge; William C. Probst, Ramsey, both of N.J.; James P. Coffey, Warwick; Charles J. Knipple, Cornwall, both of N.Y.

[73] Assignee: The International Nickel Co., Inc., New York, N.Y.

[21] Appl. No.: 59,519

[22] Filed: Jul. 23, 1979

[51] Int. Cl.[3] ..... C25C 1/08; C25C 7/02

[52] U.S. Cl. ..... 204/281; 204/3; 204/10; 204/112

[58] Field of Search ..... 204/281, 112, 10, 12, 204/3, 290 R

[56] References Cited

U.S. PATENT DOCUMENTS

| | | | |
|---|---|---|---|
| 3,860,509 | 1/1975 | Emmett, Jr. | 204/281 |
| 4,040,915 | 8/1977 | Fisher | 204/12 X |
| 4,082,641 | 4/1978 | Parkinson et al. | 204/281 |

*Primary Examiner*—Arthur C. Prescott

*Attorney, Agent, or Firm*—F. J. Mulligan

[57] ABSTRACT

A polymeric electroforming mandrel having a metal base, eg. a layer of expanded sheet steel, and a polymeric layer surrounding such base, the layer having inserts of electroconductive polymer interspersed in a continuous area of non-conductive polymer and the layer comprising welded or otherwise hermetically joined units lying in the same plane.

6 Claims, 2 Drawing Figures

MANDREL FOR NICKEL ROUNDS WITH A MONOLITHIC SURFACE

The present invention is concerned with a polymeric electroforming mandrel and, more particularly, with a planar polymeric electroforming mandrel.

BACKGROUND OF THE INVENTION AND PRIOR ART

The present invention is concerned with mandrels for producing electroformed shapes suitable for use as anode material in titanium baskets for electroplating. Such shapes, in particular, nickel Rounds (TradeMark INCO, Ltd.) have been produced in the past on mandrels which have a base made of a stainless steel sheet and an insulating coating, such as an epoxy enamel. This insulating coating covers the entire surface of the mandrel except for open areas in the desired shape of the electroformed pieces. Typically, such a mandrel will be a stainless steel sheet, one meter square, possibly 1 to 5 mm thick and having a multiplicity of circular open areas in the epoxy coating each having diameters of about 19 to about 32 mm. The difficulty with these mandrels is that they will be satisfactory for only a relatively short period of time, such as ten (10) electroforming cycles. At the end of their useful life, the mandrels must be stripped of the epoxy coating and refinished. This takes substantial time and is costly.

In U.S. application Ser. No. 864,274, filed Dec. 27, 1977, now U.S. Pat. No. 4,158,612, Messrs. Luch and Chart described a polymeric mandrel for electroforming, which consists essentially of an electroconductive base, an electroconductive polymeric sheet superimposed on that base and a masking layer of non-electroconductive polymeric material overlaying the electroconductive polymeric layer. The masking layer has a number of holes cut therethrough in order to provide access of electrolyte to the electroconductive layer and to establish the shape of the items to be electroformed. Again typically, the electroformed items are discs and the cutouts in the masking layer are circular. U.S. Pat. No. 4,040,937 of record in the file of U.S. application Ser. No. 864,274, is concerned with an electroconductive polymeric mandrel but discloses use of this mandrel for forming starting sheets. There is no disclosure or suggestion in this patent of any mandrel which will produce items having a maximum of a major dimension of about 50 mm. A difficulty with the mandrel of U.S. application Ser. No. 864,274 is that, in use, the electrodeposited material on the electroconductive polymer layer tends to enlarge the area exposed to electrolyte. Although the joint between conductive and non-conductive material is designed to be a hermetically sealed joint, in that, there is a continuity of polymer in both the electroconductive and non-conductive layer, it has been found that the lateral growth of metal during electrodeposition can cause enormous pressures and can deform the shape and size of the openings in the masking layer despite the excellent bond existing between the masking layer and the electroconductive layer.

OBJECTS AND SHORT DESCRIPTION OF THE DRAWINGS

The present invention is an improvement with respect to the mandrel as described in the U.S. application Ser. No. 864,274. It is an object of the present invention to provide a novel improved mandrel.

Other objects of the present invention will become apparent from the following description taken in conjunction with the drawing in which FIG. 1 is external view of the improved mandrel of the present invention; and FIG. 2 is a cross-sectional view of the mandrel as depicted in FIG. 1 along the lines II—II.

DETAILED DESCRIPTION OF THE INVENTION

Generally speaking, the present invention comprises a mandrel for electroforming which comprises an electroconductive base, usually a sheet or extended area of grid or mesh made of copper, steel or other metal. This metallic base has superimposed on at least one side thereof, a single layer of polymeric material having within that single layer co-planar, hermetically joined areas up to about 50 mm in major dimension of electroconductive material interspersed in a continuous area of non-conductive material. At least one layer of polymeric material is adhered to and envelops the electroconductive base, such that, when in use, electrolyte sees only the polymeric layer.

Figure 1:
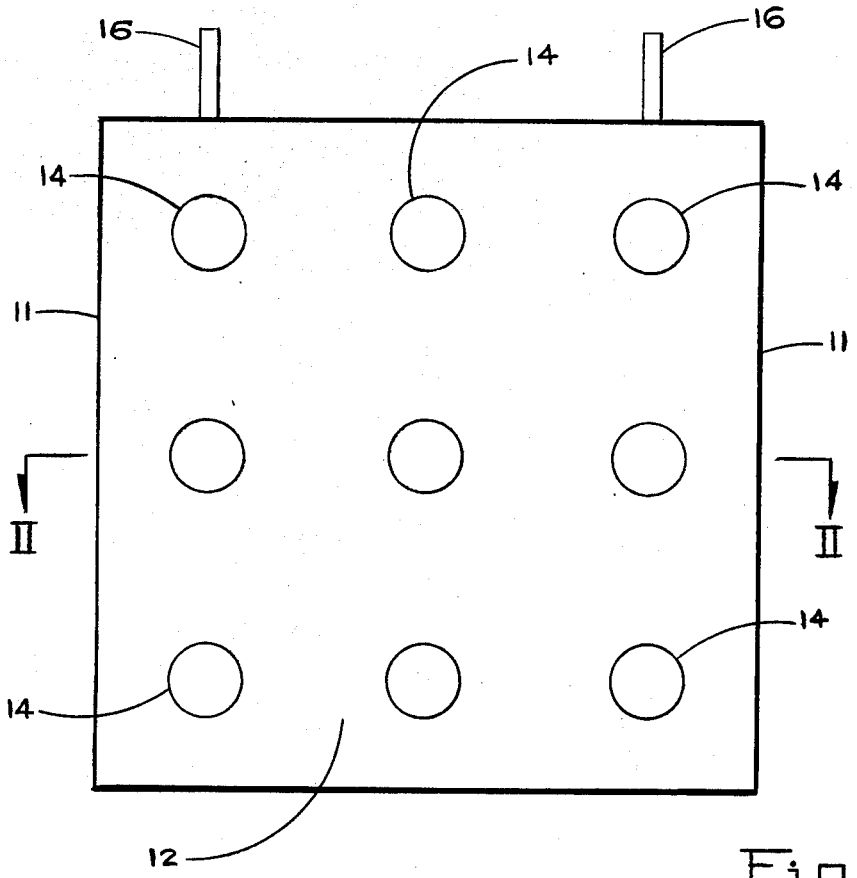
Figure 2:
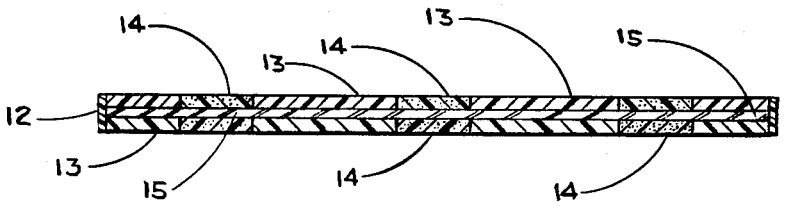

The mandrel of the present invention is specifically shown in the drawing. Referring now to FIG. 1 thereof, mandrel 11 is depicted having hangers 16 by which the mandrel can be suspended from bus bars not shown. Mandrel 11 has outer coating 12 comprising a matrix of non-conductive resin 13 and a plurality of islands 14 of conductive resin. This conductive resin, eg. a polymer-carbon black mix has a resistivity not greater than about 100 ohm-centimeters and contains a polymer the same as or at least compatible with (melt weldable to) the polymer of the non-conductive matrix. As shown in FIG. 2, the outer polymeric layer, layer 12 is a single layer which has non-conductive areas 13 and conductive areas 14 co-planar with each other. By this means, metal cathodically growing on conductive areas 14 can exert no mechanical force on non-conductive polymeric material 13. Thus the bond which exists between the conductive and non-conductive polymeric areas remains uneffected by the growth of metal on the conductive area. At the same time, metal base 15 is completely protected from electrolyte by means of the polymeric layer 12.

The mandrel of the present invention is prepared by selecting a metal or other highly electroconductive substrate and affixing hangers 16 thereto. The metal base preferably in the form of an extended sheet is then laminated on at least one side but preferably both sides with a plastic sheet having selected areas of conductive plastic. For test purposes, this plastic sheet has been made by taking a sheet of polypropylene plastic 3.2 mm thick, cutting circular holes in the sheet by a means of a mechanical drill; cutting plugs for such holes from a sheet of similar thickness of plastic made conductive with dispersed carbon black; inserting the plugs in the holes in the first-mentioned plastic sheet; and then, welding the plugs in place by means of ultra-sonic welding at the sheet-plug joint. Those skilled in the art will appreciate that other means of producing a unitary plastic sheet having selected electroconductive areas can be devised and that the methods used by applicants have been essentially for demonstration purposes only. The metal base, advantageously having a few perforations therein, is then sandwiched in a press between two slightly larger sheets of the aforedescribed plastic and, under heat and pressure the components are laminated together with only hangers 16 being exposed.

Plastic sheets used in the process of the present invention can be made of any water-insoluble polymer stable in aqueous electrolytic media under cathodic, hydrogen generating condition. Suitable polymers for use in such plastic sheets include polypropylene, polyethylene, polysulfone, polyvinylchloride and polyester reinforced with glass. For ease of manufacture, it is advantageous for the polymer of the plastic sheet to be a thermoplastic material free of leachable plasticizers or the like. However, under appropriate circumstances thermosetting materials can also be used.

In order to give those skilled in the art a better understanding of the present invention the following examples are given.

EXAMPLE 1

Using two 0.32 cm polypropylene sheets, 1.43 cm diameter holes were drilled in a spacing pattern in which holes in a horizontal line are spaced about 2.7 cm, center-to-center, horizontal lines are spaced about 2.5 cm apart center line to center line and holes in every other horizontal line are offset from each other.

These holes were filled with plugs 0.007 cm larger in diameter than the holes themselves. The plugs were of the same thickness as the polypropylene sheets, and carbon-black filled so as to be conductive.

A sheet of nickel-plated mild steel was used as a current conductor and sandwiched between the polypropylene sheets. This sandwich was then preheated at 170° C. for 3 hours and then pressed with about 4 kg/cm$^2$ pressure at 170° C.

EXAMPLE 2

A sandwich structure consisting of the same material used in Example 1 was used except that the steel current conductor had 0.47 cm holes punched around the outside perimeter to try for better bonding between metal and plastic.

EXAMPLE 3

A sandwich structure of nickel-plated mild steel sheet and polypropylene sheets, same as in Example 2 was made up except the holes in the outside perimeter were filled with plugs of non-conductive polypropylene before pressing together. This was done to improve the bond between plastic and metal.

EXAMPLE 4

A sandwich structure the same as in Example 3 was made up, except that additional holes were punched in the current conductor to correspond to the same pattern as the conductive plastic plugs in the polypropylene sheets, for more uniform current distribution and added strength throughout the whole electroforming mandrel.

EXAMPLE 5

A sandwich structure the same as Example 4 was made up except that stainless steel was used in place of the nickel-plated mild steel. Also the holes corresponding to the same pattern as the conductive plugs were filled with plugs of conductive plastic before pressing, to enhance current distribution to the conductive plugs in the polypropylene sheets.

EXAMPLE 6

A sandwich structure comprising two sheets of polypropylene with inserted conductive plugs on both sides of and surrounding a central core of expanded steel sheet was made to replace the sandwich structures described in Examples 1 thru 5. This structure was pressed at the same pressure and temperature used in the previous examples.

EXAMPLE 7

A sandwich structure the same as in Example 6 was made up with the exception that conductive plastic pellets were put inside the expanded metal openings to correspond to the pattern of the conductive plugs in the polypropylene sheets. This is the preferred method to be used before pressing the mandrel.

The preceeding seven examples of electroforming mandrels were designed to be used in conventional metal electrorecovery baths, especially nickel electrorefining and electrowinning baths. A current density of about 5.4 amps/dm$^2$ was employed for the deposition of nickel. In each instance, the performance of the sandwich structure electroforming mandrel was satisfactory even after numerous repetitive cycles of deposition of nickel.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A mandrel for use in an electrolyte for electroforming items having a major dimension no greater than about 50 mm comprising a sheet-form base of high electroconductivity laminated to a polymeric sheet having integral therein polymeric electroconductive areas of major dimension no greater than about 50 mm isolated one from the other by a co-planar matrix of compatible non-conductive polymer said polymeric sheet and said matrix of compatible non-conductive polymer together isolating said sheet form base of high electrical conductivity from said electrolyte.

2. A mandrel as in claim 1 wherein the sheet-form base of high electroconductivity is a metal base.

3. A mandrel as in claim 2 wherein the metal base is a sheet of expanded metal.

4. A mandrel as in claim 3 wherein the sheet of expanded metal is of mild steel.

5. A mandrel as in claim 3 wherein the electroconductive areas are essentially circular.

6. A mandrel as in claim 1 wherein the polymeric sheet is made of polypropylene, polyethylene, polysulfone, polyvinylchloride or polyester reinforced with glass.

* * * * *